US005680904A

United States Patent [19]

Patterson

[11] Patent Number: 5,680,904

[45] Date of Patent: Oct. 28, 1997

[54] IN-THE-HOLE PERCUSSION ROCK DRILL

[76] Inventor: William N. Patterson, Box 1309, Montrose, Colo. 81402-1309

[21] Appl. No.: 564,916

[22] Filed: Nov. 30, 1995

[51] Int. Cl.[6] ..... E21B 4/14

[52] U.S. Cl. ..... 173/13; 173/73; 173/78; 173/80; 173/91; 173/112; 173/206; 175/296; 91/269

[58] Field of Search ..... 173/13, 15, 16, 173/73, 78, 80, 91, 112, 206; 175/19, 296; 91/50, 51, 269

[56] References Cited

U.S. PATENT DOCUMENTS

| | | | |
|---|---|---|---|
| 3,167,136 | 1/1965 | Cook | 173/80 |
| 3,896,889 | 7/1975 | Bouyoucos | 173/120 |
| 3,903,972 | 9/1975 | Bouyoucos et al. | 173/134 |
| 4,044,844 | 8/1977 | Harris et al. | 173/73 |
| 4,054,180 | 10/1977 | Bassinger | 173/80 |
| 4,150,603 | 4/1979 | Etherington et al. | 91/50 |
| 4,474,248 | 10/1984 | Musso | 173/17 |
| 4,646,854 | 3/1987 | Arndt et al. | 173/134 |
| 4,660,658 | 4/1987 | Gustafsson | 175/296 |
| 4,828,048 | 5/1989 | Mayer et al. | 173/134 |
| 5,014,796 | 5/1991 | Gustafsson | 175/296 |
| 5,025,865 | 6/1991 | Wentworth et al. | 173/91 |
| 5,107,944 | 4/1992 | Gustafsson | 175/296 |
| 5,293,959 | 3/1994 | Kimberlin | 173/78 |
| 5,307,881 | 5/1994 | Kimberlin | 173/73 |
| 5,488,998 | 2/1996 | Ekwall et al. | 173/91 |
| 5,564,510 | 10/1996 | Walter | 173/80 |

*Primary Examiner*—Scott A. Smith
*Attorney, Agent, or Firm*—Michael E. Martin

[57] ABSTRACT

A hydraulic reciprocating percussion tool, particularly adapted for drilling applications, comprises an elongated cylinder, opposed fronthead and backhead members and a central bore in the cylinder for supporting a reciprocating piston hammer. The piston hammer has reduced diameter end portions which have respective tubular sleeve valves disposed in sleeved relationship thereon and engageable with valve retainer members on the reduced diameter portions for effecting movement of the valves with the piston hammer. The head members include tubular sleevelike stem portions which cooperate with the respective valves to valve pressure fluid to and from opposed chambers in the cylinder to effect repeated impact blow delivering strokes to a shank member disposed in a chuck connected to the fronthead. The sleeve valve disposed between the piston hammer and the fronthead operates to vent pressure fluid from the forward chamber and the sleeve valve disposed between the piston hammer and the backhead effects valving of pressure fluid to both opposed chambers in the drill. The provision of the opposed sleeve valves and a central passage in the hammer for conducting pressure fluid to the forward end of the drill provides for a reduced diameter cylinder for slim hole and in-the-hole drilling operations.

22 Claims, 3 Drawing Sheets

IN-THE-HOLE PERCUSSION ROCK DRILL

FIELD OF THE INVENTION

The present invention pertains to an in-the-hole reciprocating piston percussion rock drill having opposed hammer actuated valves at each end of the drill cylinder for valving pressure fluid to and from the cylinder to effect reciprocation of the piston hammer.

BACKGROUND OF THE INVENTION

In the art of fluid actuated reciprocating piston percussion drills and similar tools, it is known to provide sliding sleeve-type valves for valving pressure fluid to effect reciprocation of a fluid actuated piston hammer. The uses of fluid actuated reciprocating piston-type percussion drills and similar impact tools are substantial. There are many applications of these types of drills wherein the diameter of the hole to be drilled is relatively small, i.e., about 2.0 inches or less. Moreover, there are also applications for reciprocating piston percussion drills wherein the drill must be inserted within a conduit or tubing string for cleanout of the conduit or for utilization of the conduit as a guide structure.

One problem associated with providing relatively small diameter reciprocating piston percussion drills arises when it is considered necessary to provide high pressure fluid passages through the cylinder from one end of the drill to the other to supply pressure fluid to both ends of the piston hammer to effect reciprocation thereof. In smaller diameter drills, the necessary wall thickness of the drill cylinder and the necessary maximum diameter for the reciprocating piston hammer to provide suitable energy delivery by the drill work at cross purposes with the need to provide a relatively unobstructed passageway between the piston hammer and the cylinder outer diameter from the fluid inlet end of the drill to the end of the cylinder near the anvil or the member which the hammer is impacting.

Another factor to be taken into consideration in developing relatively small diameter drills is the provision of suitable valving for effecting application of pressure fluid to both ends of the piston hammer and for venting the pressure fluid from the cylinder chamber in such a way so as to maximize drill performance and to reduce maintenance problems associated with the valving. To this end, reciprocating, so called sleeve-type valves, have been developed for reciprocating piston percussion drills. Examples of drills which do not have an overall diameter restriction and which utilize fluid actuated or hammer actuated sleeve valves are disclosed in U.S. Pat. Nos. 3,896,889 and 3,903,972, both to J. V. Bouyoucos, 4,044,844 to Harris, et. al., 4,150,603 to Etherington, et. al., 4,474,248 to Musso and 4,646,854 to Arndt et. al.

U.S. Pat. No. 4,828,048 to James R. Mayer and William N. Patterson pertains to a fluid actuated percussion drill wherein a single sleeve valve is disposed at the fluid inlet end of the drill cylinder and is operable to be moved in one direction by the piston hammer and in the opposite direction by pressure fluid which is transferred to a chamber in the drill to act on a pressure surface when the piston hammer uncovers a fluid transfer port. Although only a single sleeve valve is provided in the drill described in the '048 patent, the drill design, of necessity, provides fluid transfer passages disposed between the outer cylinder and an inner cylinder or liner. This type of construction tends to restrict the minimum outside diameter or requires that the fluid passages or the piston diameter be of inadequate size for certain applications. The configuration of the drill described in the '048 patent also requires a pressure fluid accumulator structure at one end of the drill.

However, as mentioned previously, it is desirable to provide maximum drilling energy in many applications of percussion drills with a drill having an outer diameter as small as possible. It is also desirable to provide a fluid actuated percussion drill which may be easily assembled and disassembled, wherein the parts thereof are relatively easy to fabricate and to simplify the drill as much as possible to minimize the chance of failure or early replacement of working parts. It is to these ends that the present invention has been developed.

SUMMARY OF THE INVENTION

The present invention provides an improved fluid actuated percussion tool, particularly adapted for rock drilling. In particular, the invention also contemplates the provision of a relatively small diameter, hydraulically actuated, reciprocating piston-type percussion rock drill for drilling relatively small diameter holes and for disposition within conduits and the like for drilling out debris or relatively hard materials disposed therein.

In accordance with one aspect of the present invention, a unique fluid actuated reciprocating piston percussion tool is provided which includes opposed sleeve-type piston hammer actuated valves for effective valving of pressure fluid to cause reciprocation of the piston hammer. At least one of the valves is operable in conjunction with a pressure fluid passageway disposed in the piston hammer for receiving working fluid from a fluid inlet end of the drill to effect flow of working fluid for drill hole flushing and for actuation of the piston hammer, depending on the positions of the piston hammer and the valve. The second valve is disposed at the opposite end of the piston hammer and is also arranged in sleeved relationship over a reduced diameter portion of the piston hammer for operation in conjunction with the movement of the piston hammer to provide flow of pressure fluid. The opposed sleeve-type valves are also disposed on opposite, reduced diameter end portions of the piston hammer, respectively, for movement with the piston hammer and for movement relative to the piston hammer.

In accordance with other important aspects of the invention, a fluid actuated reciprocating piston hammer percussion tool is provided having a unique arrangement of bearings supporting tubular sleeve valves on the piston hammer and on a portion of the drill cylinder or a head member therefor. Still further, the reciprocating piston-type percussion tool of the invention includes a unique arrangement of parts including an elongated cylinder member, opposed fronthead and backhead members, reciprocating sleeve valves and an elongated piston hammer having valve supporting reduced diameter portions at opposite ends thereof.

Those skilled in the art will further appreciate the unique structural and operating features of the fluid actuated percussion tool of the present invention together with other important aspects thereof upon reading the detailed description which follows in conjunction with the drawing.

DESCRIPTION OF A PREFERRED EMBODIMENT

Figure 1:
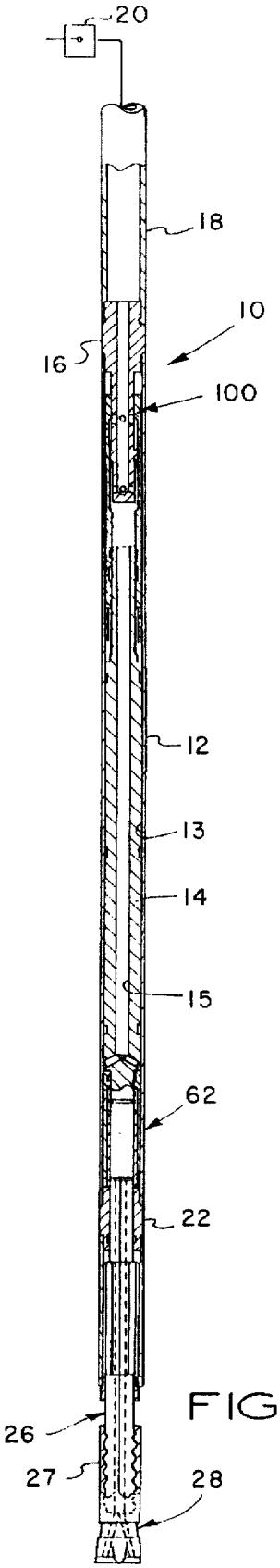
FIG. 1 is a longitudinal central section view of the fluid actuated percussion drill of the present invention.

In the description which follows, like parts are marked throughout the specification and drawing with the same reference numerals, respectively. The drawing figures are not necessarily to scale. Drawing FIGS. 2A through 2D, when viewed placed end-to-end along the matching parting lines a—a, b—b, and c—c, comprise, substantially, a longitudinal central section view of the hydraulic fluid actuated percussion drill shown in FIG. 1.

Referring to FIG. 1, there is illustrated a unique hydraulic percussion drill or tool in accordance with the invention and generally designated by the numeral 10. The drill 10 is particularly adapted for drilling relatively small diameter holes, on the order of 1.50" diameter to 2.0" diameter, for example, for many applications, including blastholes, holes in rocks for inserting conduits or tube, and for cleaning the interior of tubes or pipes, such as used in the oil well drilling industry, for example. As shown in FIG. 1, the drill 10 includes an elongated tubular cylinder 12 having a longitudinal bore 13 in which is disposed a reciprocating piston hammer 14. The cylinder 12 is connected to a backhead member 16 which, in turn, is adapted to be connected to an elongated rotatable tubular drill stem 18. A source of pressure fluid, such as high pressure water, and indicated at 20, is adapted to be in communication with the drill stem 18 for conducting working fluid to the drill 10. The cylinder 12 is also connected to a fronthead 22 which supports a tubular chuck member 24. The chuck 24 is adapted to support an impact blow receiving and transmitting shank member 26 which is adapted to be threadedly connected to a conventional percussion rock bit 28 having an internally threaded stem 27.

Working fluid, such as high pressure water from the source 20, may be conducted down through the drill stem 18 to effect relatively high speed reciprocation of the piston hammer 14 to impact the shank 26 for transmitting percussion blows to the bit 28, for penetration of rock and other hard, frangible material which may be rubblized or reduced to small chips. These chips are evacuated from a hole, not shown, being formed by the tool or drill 10 utilizing spent working fluid which is directed down through suitable passages in the shank 26 and the bit 28, in a known manner, and to be described further herein. In the position of the shank 26 and the hammer 14 shown in FIG. 1, working fluid, such as high pressure water, may be directed down through the interior of the drill 10, including an elongated passage 15 formed in the piston hammer 14, and discharged from the drill through a suitable bore formed in the shank 26 and conventional cooperating passages formed in the bit 28. In the particular position of the piston hammer 14 shown in FIG. 1, the drill 10 is nonworking and water or other suitable working fluid is directed through the passage 15 and the shank 26 continuously. A detailed description of the further components of the drill 10 and the manner in which the operating modes of the drill occur is set forth hereinbelow in conjunction with FIGS. 2A through 2D. Basically, the drill 10 may be utilized in many percussion tool applications for drilling elongated holes, cleanout of tubing and pipe, and virtually any application that requires disintegration of rock-like material. Thanks to the unique structural features of the drill 10 to be described further herein, the drill may be constructed to be of relatively small diameter for applications requiring same.

Figure 2A:
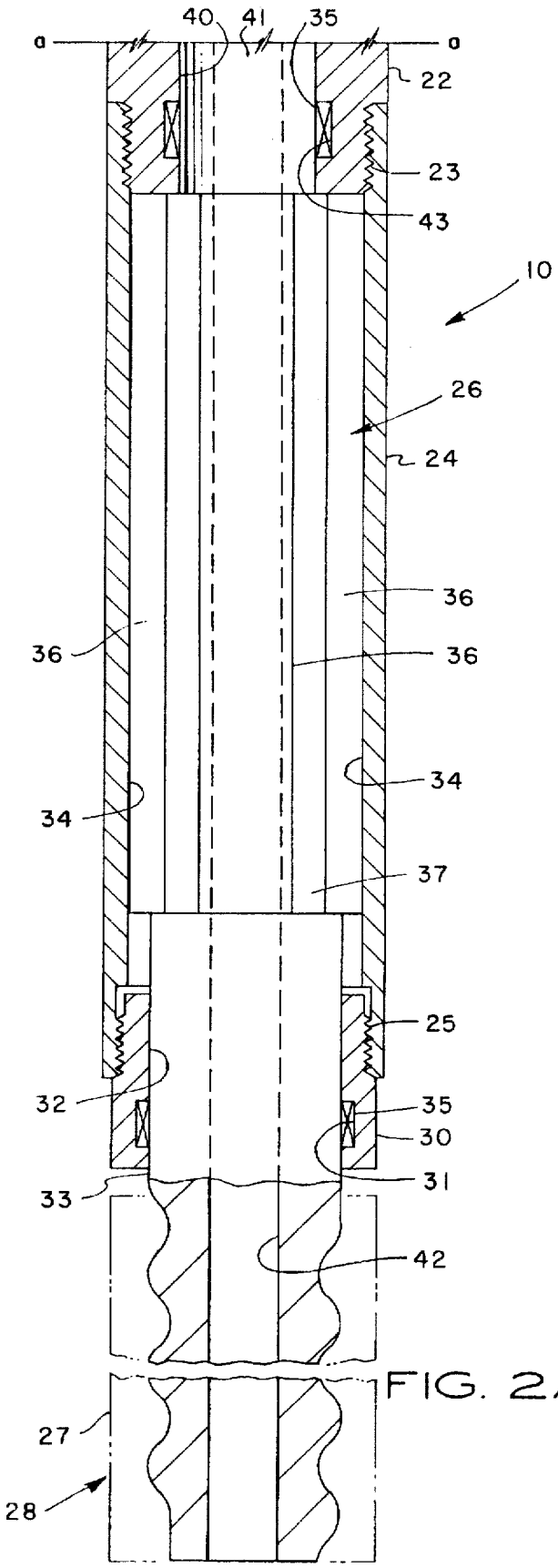
FIGS. 2A through 2D are detail section views, on a larger scale, of the percussion drill shown in FIG. 1 and are intended to be viewed, connected end-to-end, at the respective matched parting lines indicated on the respective figures.

Referring now to FIG. 2A the so-called lower end of the drill 10 is illustrated in detail, including the fronthead 22 and the chuck 24. The fronthead 22 includes a reduced diameter, threaded portion 23 which is threadedly coupled to the elongated generally cylindrical tubular chuck member 24. The opposite end of the chuck 24 is provided with suitable internal threads 25 for coupling the chuck to a generally cylindrical shank retainer 30 having a cylindrical bore 32 formed therethrough for journalling a cylindrical stem portion 33 of the shank 26 for limited axial sliding movement within the chuck 24. The chuck 24 includes circumferentially-spaced apart and longitudinally or axially extending grooves 34 which cooperate with longitudinally extending flutes 36 formed on a shank body 37 in a known manner whereby the shank 26 is operable to undergo limited axial sliding movement within the chuck 24 but is operable to be rotated with the chuck and the entire drill 10 upon rotation of the drill stem 18, in a known manner. The retainer 30 is also provided with a circumferential recess 31 for receiving a bearing member 35, typically formed as a split sleeve or collar member to facilitate installation in and removal from recess 31, and formed of a suitable bearing material not requiring external lubrication.

Figure 2B:
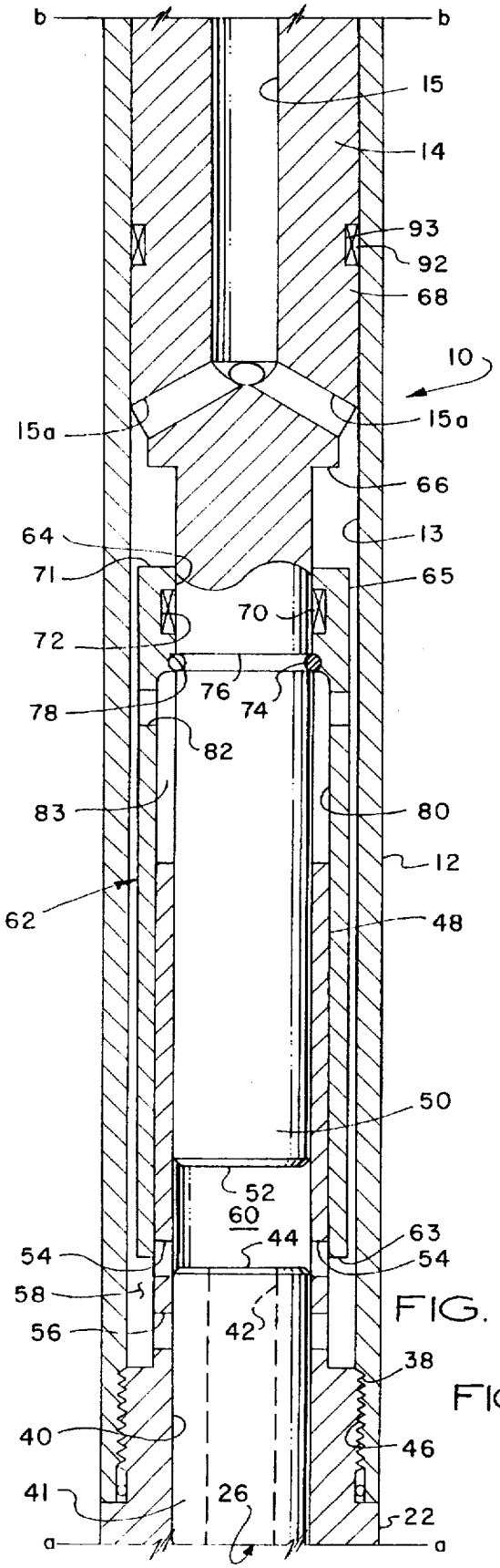

Referring further to FIG. 2A, and also FIG. 2B, the fronthead 22 comprises a generally cylindrical body having opposed reduced diameter threaded portions 23 and 38, and a central, generally cylindrical bore 40 for receiving a cylindrical anvil portion 41 of the shank 26 slidably therein. A split sleeve type bearing 35 is also disposed in a circumferential recess 43 in the fronthead 22 for journalling shank portion 41. As shown in FIGS. 2A and 2B, the shank 26 is also provided with an elongated central passage 42 extending from a transverse impact blow receiving anvil surface 44, FIG. 2B, entirely through the shank for communicating pressure fluid to the bit 28.

As shown in FIG. 2B, the fronthead 22 is threadedly coupled to the lower end of cylinder 12 at cooperating threads 46 formed thereon. The fronthead 22 is further characterized by a reduced diameter cylindrical tubular sleeve portion 48 formed thereon and extending upward within the cylinder 12, in the position of the illustrative drawing figures, and in sleeved relationship over a lower cylindrical distal end portion 50 of the piston hammer 14. The piston hammer distal end portion 50 includes an impact blow delivering surface 52 formed thereon for impacting the blow receiving surface 44 of the impact blow receiving and transmitting member comprising the shank 26. As shown in FIG. 2B, the sleeve portion 48 of the fronthead 22 is provided with two sets of axially-spaced apart ports 54 and 56 which open from a chamber 58 into a chamber 60, depending on the position of the shank 26 and the piston hammer 14. The chamber 58 is formed within cylinder 12 between the fronthead 22 and the piston hammer 14 and the chamber 60 is formed within sleeve portion 48 between the shank 26 and the piston hammer. As shown in FIG. 2B, the anvil portion 41 of the shank 26 has closed over the ports 56 in the position shown whereas the ports 54 are operable to communicate pressure fluid between chambers 58 and 60 so that such fluid may be delivered through passage 42 in the shank to the bit 28.

With further reference to FIG. 2B, the drill 10 includes a piston hammer actuated valve 62 comprising an elongated cylindrical tubular sleeve member disposed in sleeved relationship around the reduced diameter portion 50 of the piston hammer 14 and also in sleeved relationship over the sleeve portion 48 of the fronthead 22. The sleeve valve 62 has a first cylindrical bore portion 64 formed therein at an end 65 which is disposed adjacent to a transverse shoulder 66 formed on the piston hammer 14 at the juncture between a main body 68 of the piston hammer and the reduced diameter portion 50 thereof. A suitable split sleeve bearing 70 is disposed in a circumferential recess or groove 72 formed in the sleeve valve 62 to permit axial sliding movement of the valve on and relative to the reduced diameter portion 50 of the piston hammer 14. The valve 62 is adapted for limited movement axially, relative to the hammer portion 50, as determined by the shoulder 66 and a split, elastically expansible retaining ring 74 operable to be disposed in a suitable circumferential groove 76 in the reduced diameter portion 50 of the piston hammer.

The sleeve valve 62 is provided with an axially stepped shoulder 78 interposed between the bore 64 and a larger diameter bore portion 80 of the valve. The diameter of the bore portion 80 is slightly larger than the outside diameter of the sleeve portion 48 of the fronthead 22 to permit axial sliding movement of the valve 62 with respect to the sleeve portion 48 and the ports 54. In this regard, a lower transverse edge 63 of the valve 62 is predetermined to provide for controlling flow of pressure fluid from the chamber 58 to the chamber 60 through the ports 54. The arrangement of the retaining ring 74 and the shoulder 78 is such that the valve 62 is operable to be moved by the piston hammer 14 when the piston hammer is moving upwardly, viewing FIG. 2B, while the piston hammer may move relative to the sleeve valve 62 in a downward direction during an impact blow delivering stroke of the hammer or when the drill 10 is in a nonworking or idle mode with the shank 26 displaced downwardly until the flutes 36 engage the retainer 30.

The valve 62 is also provided with plural circumferentially-spaced ports 82 opening between the bore 80 and the exterior surface of the valve. The ports 82 are disposed generally adjacent the shoulder 78. The ports 82 are operable to valve pressure fluid between an annular chamber 83 formed between the reduced diameter portion 50 of the hammer and the valve and between the sleeve portion 48 and the transverse shoulder 78. Pressure fluid is vented between the chamber 83 and the chamber 58 to permit movement of valve 62.

In the position of the piston hammer 14 shown in FIGS. 2A through 2D, pressure fluid may be conducted down through the passage 15 in the piston hammer, through branch passages **15*a*, into chamber 58, including that portion of chamber 58 between the cylinder bore 13 and the sleeve valve 62, through the ports 54 into chamber 60 and into the central passage 42 of the shank 26 to be exhausted from the drill 10. In the position of the piston hammer 14 shown in FIGS. 2A through 2D, the piston hammer is moving upwardly, viewing the drawing figures, and moving the valve 62 with it to uncover the ports 54 by the control edge 63 on the valve. Once the control edge 63 has uncovered ports 54, fluid pressure in chamber 58 is relieved as the fluid flows into chamber 60 and down through the passage 42**.

Figure 2C:
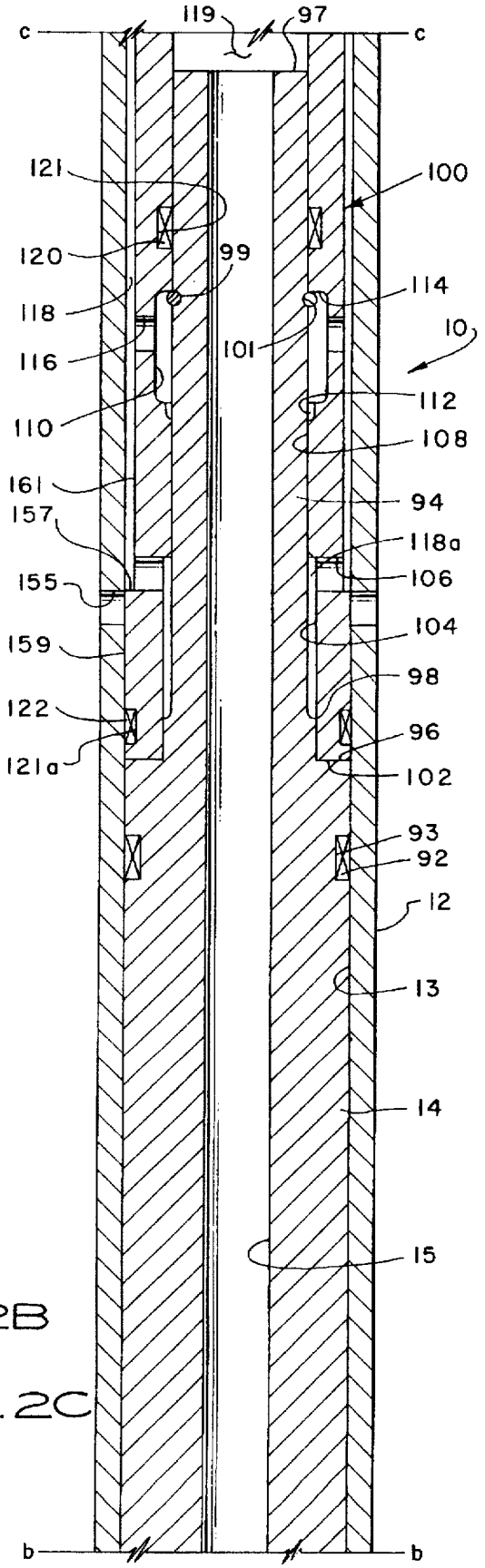

Referring now to FIGS. 2B and 2C, the elongated central body portion 68 of piston hammer 14 is slightly less in diameter than the bore 13 of the cylinder 12, and is supported in the bore for reciprocating sliding movement therein on spaced apart split sleeve bearings 92 which are suitably disposed in spaced apart circumferential grooves 93 formed in the piston hammer. As shown in FIG. 2C, the upper end of the piston hammer 14 is provided with an elongated, cylindrical, reduced diameter portion 94. A transverse shoulder 96 is formed at a juncture between portion 94 and the main body portion 68. The reduced diameter portion 94 includes a short, axially extending cylindrical shoulder 98 disposed between the transverse shoulder 96 and the reduced diameter portion 94. The reduced diameter portion 94 terminates at a transverse end face 97 and is provided with a split, elastically expansible retaining ring 99 disposed in a suitable circumferential groove 101 intermediate the end face 97 and the shoulder 96.

Figure 2D:
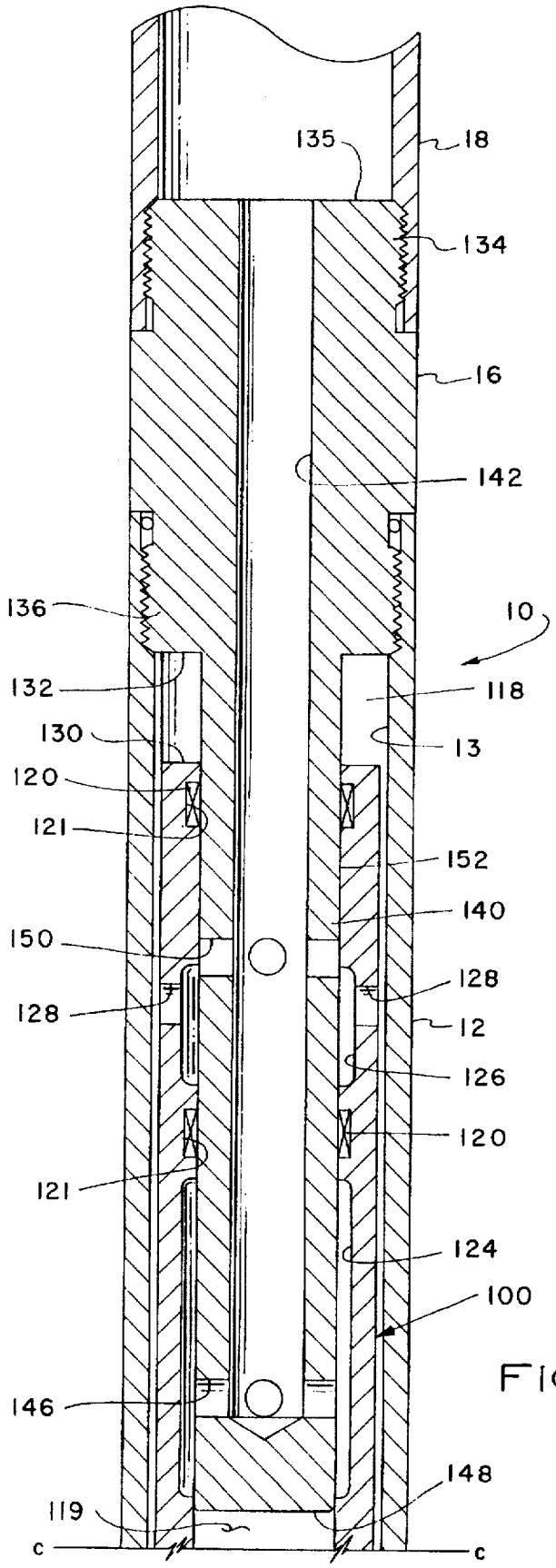

As shown in FIGS. 2C and 2D, an elongated cylindrical tubular sleeve valve 100 is disposed in sleeved relationship around the piston hammer portion 94 for movement with the piston hammer 14 and relative to the piston hammer in a manner to be described in further detail herein. The sleeve valve 100 has a lower transverse end face 102, shown contiguous with the shoulder 96 in FIG. 2C, and a first cylindrical bore portion 104 extending from the end face 102 to circumferentially spaced radially extending ports 106. The sleeve valve 100 has a second axially extending bore 108, slightly less in diameter than the bore portion 104, and extending to an elongated circumferential groove 110. The groove 110 is delimited by opposed transverse shoulders 112 and 114. FIG. 2C, and, together with retaining ring 99, forms a lost motion coupling between valve 100 and piston hammer 14. Circumferentially spaced, radially extending ports 116 open from the recess 110 into an annular chamber 118 formed in part between the sleeve valve 100 and the cylinder bore 13 and between the transverse shoulder 96 and the backhead 16. The sleeve valve 100 is also provided with spaced apart circumferential grooves 121 and **121*a* for receiving suitable cylindrical split bearing sleeves 120 and 122, respectively, FIGS. 2C and 2D, for supporting the sleeve valve for sliding movement on the piston hammer portion 94 and in bore 13**.

Referring further to FIG. 2D, the sleeve valve 100 includes a second elongated annular recess or groove 124 formed therein, as shown, and a third, axially-spaced annular recess or groove 126 having a plurality of radially extending ports 128 in communication therewith and with the chamber 118. The upper distal end of the sleeve valve 100 is delimited by a transverse end face 130 which faces a transverse shoulder 132 formed on the backhead 16. As further shown in FIG. 2D, the backhead 16 has an externally threaded portion 134 for threadedly connecting the drill 10 to the tubing string 18 and an opposed, externally threaded portion 136 for threadedly coupling the backhead to the cylinder 12. The backhead 16 also includes an elongated, tubular reduced diameter stem portion 140 extending from shoulder 132 and operable to at least partially support the sleeve valve 100 for sliding movement thereon at respective spaced apart sleeve bearings 120, as shown. The backhead 16 also includes an elongated axial passage 142 formed therein extending from an upper distal end face 135 to radially extending ports 146 disposed just above, and spaced from, a lower transverse face or control edge 148 of the stem portion 140. An intermediate set of radially extending ports 150 opens to the outer circumferential surface 152 of the stem portion 140 at a position spaced from the ports 146 and between the ports 146 and the transverse face 132.

As previously mentioned, the position of the piston hammer 14, the sleeve valve 62, and the sleeve valve 100 illustrated in the drawing FIGS. 2A through 2D is a condition wherein working fluid may be supplied to the drill 10 through the passage 142, the ports 150, the groove 126 and the ports 128 into the chamber 118. Pressure fluid is also supplied to the ports 146 and the groove 124. However, the control edge 148 has closed off fluid communication between the groove 124 and chamber 119 formed between the control edge and the upper face 97 and passage 15 of piston hammer 14.

As shown in FIG. 2C, the cylinder 12 is also provided with plural, circumferentially-spaced fluid exhaust ports 155 and, in the position of the hammer 12 and the sleeve valve 100 shown in FIG. 2C, a control edge 157 formed between a first cylindrical portion 159 of the valve and a second cylindrical portion 161 has closed off communication between the exhaust ports and the chamber 118. Accordingly, in the position of the piston hammer 14 and the valves 62 and 100, shown in FIGS. 2A through 2D, chamber 58 has just been opened to vent pressure fluid through ports 54, chamber 60 and the shank passage 42 to reduce pressure in chamber 58. Prior to movement of the piston hammer 14 to the position shown in FIG. 2B, the control edge 63 had covered the ports 54 and pressure fluid was available through the passage 15 to chamber 58 to act on the transverse end face of the piston hammer defined between the reduced diameter portion 50 and the main body 68 to drive the piston hammer upwardly toward backhead 16. However, as the piston hammer 14 moves the valve 100 to the position shown in FIGS. 2C and 2D, high pressure fluid is cut off from chamber 119 and passage 15 while the fluid in chamber 58 is vented to reduce the driving force moving the hammer upwardly. At the same time, as pressure fluid is placed in communication with chamber 118 by way of the passage 142, ports 150, groove 126 and ports 128, this pressure fluid is applied to act on the piston hammer transverse face 96 byway of chamber 118, ports 106 and an annular space **118*a* between the piston hammer reduced diameter portion 94 and the bore 104 of the sleeve valve 100. Exhaust ports 155 have been cut off from communication with chamber 118 by control edge 157 of valve 100**.

The momentum of the piston hammer 14 is sufficient to carry it further upwardly, viewing FIGS. 2A through 2D, while pressure fluid is applied to the chamber 118 to act on the face 96 and while pressure fluid acts on the transverse end face 102 of valve 100 causing the valve to begin to move upwardly toward the transverse face 132 and relative to the piston hammer 14. Thus, transverse shoulder 114 moves away from retaining ring 98 as working fluid pressure decelerates the piston hammer 14 to a stopped position.

With the piston hammer 14 at its maximum upward position, pressure fluid is still cut off from communication between passage 142, through chamber 119 to piston hammer passage 15. However, maximum working fluid pressure is now exerted on the transverse face 96 of the piston hammer 14 to begin driving it downwardly, viewing the drawing figures, on an impact blow delivering stroke. Since sleeve valve 62 has been carried upwardly with the piston hammer 14 towards its maximum upward or return stroke position, control edge 63 has moved away from ports 54 and chamber 58 is thus fully vented through chamber 60 into shank passage 42. Accordingly, piston hammer 14 is now operable to move downwardly with great speed and force to deliver an impact blow to the anvil surface 44 of shank 26.

As the piston hammer 14 moves downwardly under acceleration, chamber 58 continues to vent any pressure fluid remaining therein as the piston hammer displaces same from the chamber. As the piston hammer 14 moves toward the impact blow delivering position, the shoulder 66 will engage upper transverse surface 71 of sleeve valve 62, since pressure forces acting on the valve are balanced, and movement of the valve will tend to lag the downward movement of the piston hammer. Once the piston hammer 14 engages the valve 62 and carries the valve downwardly, the control edge 63 will eventually pass over the ports 54 closing off same from communication with the chamber 60. The piston hammer 14, which has been moving downward relative to sleeve valve 100 during a blow delivering stroke, engages sleeve valve 100 by way of retaining ring 101 and shoulder 112 and carries valve 100 downwardly with the piston hammer to the impact blow delivering position. At impact of piston hammer 14 with shank 26 valve 100 continues to move downwardly to a position wherein the ports 146 are placed in communication with chamber 119 by way of groove 124 thereby allowing pressure fluid to flow from passage 142 by way of chamber 119 and passages 15, **15*a* to chamber 58**.

Moreover, as the sleeve valve 100 moves downward relative to the backhead stem portion 140, ports 150 are closed off from communicating with ports 128 by way of groove 126, as the groove moves out of communication with the ports 150. Under this condition, pressure fluid is cut off from flow into chamber 118. Still further, as sleeve valve 100 moves with piston hammer 14 to the impact blow delivering position, and valve 100 continues its downward movement due to its own momentum, control edge 57 passes over ports 155 thereby placing chamber 118 and ports 106 in communication with the exhaust ports 155 to vent pressure fluid from chamber 118. In this last mentioned condition, the front chamber 58 is now pressurized and the rear chamber 118 is vented thereby causing the piston hammer 14 to reverse its direction and move upwardly toward the position shown in FIGS. 2A through 2D. As pressure fluid continues to be supplied through ports 146, groove 124, chamber 119 and passages 15, **15*a*, pressure fluid entering chamber 58 urges the piston hammer 14 upwardly. Valve 62 is moved with the piston hammer when the retaining ring 74 engages shoulder 78 until the position shown in FIGS. 2A through 2D is assumed and the cycle begins again. Valve 100 moves downward, relative to piston hammer 14 until end face 102 moves onto shoulder 98 and the valve movement toward engagement with shoulder 96 is cushioned by pressure fluid disposed between shoulder 96 and end face 102**.

The drill 10 may also be operated in an idle mode without reciprocation of the piston hammer 14 by moving the cylinder 12 to a position wherein the bit 28 is out of forcible engagement with an impact receiving surface. For example, if the shank 26 is allowed to move downwardly in the chuck 24 until it engages the retainer 30, the ports 56 are uncovered as the impact blow receiving surface 44 moves to a position to allow these ports to be in communication with chamber 58, regardless of the position of sleeve valve 62. Normally, the piston hammer 14 will move downwardly to a limit position, which is determined by pressure fluid in the chamber 58 acting on the piston hammer, including the surface 52, with enough force to hold the piston hammer out of engagement with the impact blow receiving surface 44 thereby allowing pressure fluid to flow through chamber 58 from passages 15, **15*a* and through ports 56 into the shank passage 42 to evacuate drill cuttings and the like from a hole being formed by the drill 10. In this position of the piston hammer 14, pressure fluid flowing through stem passage 142 does not enter chamber 118 but does act on surface 97 as it flows through passage 15 by way of passage 142, ports 146, groove 124 and passage 119**.

However, once the shank 26 is pushed into the position shown in FIG. 2A, by urging the drill 10 toward a rock face, not shown, ports 56 are covered by the shank body portion 41 and, since ports 54 are covered by the sleeve valve 62, fluid pressure increases rapidly in chamber 58 to urge the piston hammer 14 upwardly, viewing the drawing figures, to initiate movement of the hammer on a so-called return stroke. The piston hammer 14 will engage valve 62 by way of retaining ring 74 and move the valve upwardly as the fluid pressure in chamber 58 continues to build until the control edge 63 uncovers ports 54. Chamber 58 will then begin to vent pressure fluid through the ports 54 and chamber 60 into the shank passage 42. Concomitantly, as the piston hammer 14 moves upwardly, the sleeve valve 100 is carried by the piston hammer through engagement of shoulder 96 with valve end face 102 to cause the control edge 157 to cross over the ports 155 closing off same from communication with chamber 118 while pressure fluid is cut off from flow through passage 15 as the sleeve valve 100 and groove or recess 124 moves upward past the control edge provided by the transverse surface 148. At the same time, the annular groove 126 moves into registration with ports 150, allowing pressure fluid to flow through these ports and ports 128 into chamber 118 to begin causing pressure fluid to act on the end face 96 of the piston hammer and the operating cycle above-described begins.

Thanks to the arrangement of the sleeve valves 62 and 100, wherein these valves are placed at opposite ends of the piston hammer 14 and are cooperable with reduced diameter portions of the piston hammer to be moved in the manner described above, together with the provision of a pressure fluid supply passage extending through the piston hammer, the requirement for fluid conducting passages in the cylinder between the piston hammer and the cylinder outer wall is eliminated and the overall diameter of the drill 10 may be kept at a minimum. Moreover, the sleeve valves 62 and 100 are reliable in operation, are easily accessible for disassembly and repair, if needed, and are configured to minimize working fluid pressure losses. For example, both of the retaining rings 74 and 99 have sufficient elastic memory to be retained in their respective grooves 76 and 101 and may be removed from the grooves by a suitable tool inserted through ports 82 and 116, respectively, to permit disassembly of the sleeve valves from piston hammer 14. The drill 10 is also advantageously constructed of a minimum number of parts which may otherwise be easily assembled and disassembled as indicated from the foregoing description and the drawings. The drill 10 may also be constructed using conventional materials for hydraulic percussion tools and rock drills, particularly of the type which may be exposed to more harsh conditions by operating within a borehole itself.

Although a preferred embodiment of the invention has been described in detail, those skilled in the art will recognize that various substitutions and modifications may be made to the invention without departing from the scope and spirit of the appended claims.

What is claimed is:

1. A pressure fluid operated reciprocating piston percussion tool comprising:

an elongated cylinder member including a central bore formed therein;

a fronthead connected to said cylinder at one end and a backhead connected to said cylinder at an opposite end of said cylinder;

a reciprocating piston hammer disposed in said bore in said cylinder for reciprocation under the urging of pressure fluid supplied to first and second opposed chambers formed in said cylinder between said piston hammer and said heads, respectively;

an impact blow receiving member supported on said tool and operable to receive impact blows from said piston hammer;

a first valve disposed in said cylinder between said piston hammer and said fronthead and moveable in at least one direction with said piston hammer; and a second valve disposed in said cylinder between said piston hammer and said backhead and moveable with said piston hammer, said first and second valves being moveable with said piston hammer and relative to said piston hammer to effect valving pressure fluid to and venting pressure fluid from said chambers, respectively, to effect reciprocation of said piston hammer to deliver repeated impact blows to said impact blow receiving member.

2. The percussion tool set forth in claim 1 wherein:

said piston hammer includes elongated passage means formed therein for conducting pressure fluid to said first chamber.

3. The percussion tool set forth in claim 2 wherein:

said first valve comprises an elongated tubular sleeve member moveable with said piston hammer to uncover an exhaust port in said tool for venting pressure fluid from said first chamber.

4. The percussion tool set forth in claim 3 wherein:

said fronthead includes an elongated tubular sleeve portion extending within said cylinder in sleeved relationship within said first valve and cooperable with said first valve to vent pressure fluid from said first chamber through exhaust port means formed in said tubular sleeve portion.

5. The percussion tool set forth in claim 4 wherein:

said piston hammer includes a first reduced diameter portion disposed within said first valve and including means thereon engageable with said first valve for moving said first valve in at least one direction of movement of said piston hammer.

6. The percussion tool set forth in claim 5 wherein:

said first reduced diameter portion on said piston hammer includes a retaining ring disposed thereon for engagement with cooperating means formed on said first valve for moving said first valve in a direction to uncover said exhaust port means during a backstroke of said piston hammer.

7. The percussion tool set forth in claim 4 wherein:

said sleeve portion of said fronthead includes second port means for venting pressure fluid from said first chamber, and said percussion tool includes an impact blow receiving member operable to cover and uncover said second port means in said sleeve portion for controlling the venting of pressure fluid through said second port means.

8. The percussion tool set forth in claim 2 wherein:

said second valve includes an elongated tubular sleeve member disposed in said second chamber and cooperable with a stem portion of said backhead to effect valving pressure fluid to said second chamber and through said passage means formed in said piston hammer to said first chamber.

9. The percussion tool set forth in claim 8 wherein:

said second valve is disposed in sliding sleeved relationship over said stem portion of said backhead and over a second reduced diameter portion of said piston hammer opposed to said first reduced diameter portion.

10. The percussion tool set forth in claim 9 wherein:

said piston hammer includes means engageable with said second valve for moving said second valve in at least one direction to effect flow of pressure fluid to said second chamber.

11. The percussion tool set forth in claim 10 wherein:

said second valve is moveable with said piston hammer on a return stroke away from said impact blow receiving member to uncover fluid ports in said stem portion for flow of pressure fluid through ports formed in said second valve into said second chamber to act on said piston hammer.

12. The percussion tool set forth in claim 8 wherein:

said stem portion includes fluid ports cooperable with said second valve to shut off the flow of pressure fluid through said passage means in said piston hammer to said first chamber.

13. The percussion tool set forth in claim 8 including:

exhaust port means in said cylinder and cooperable with said second valve for venting pressure fluid from said second chamber to the exterior of said cylinder.

14. A pressure fluid operated reciprocating piston hammer percussion tool comprising:

an elongated cylinder including a central bore;

a reciprocating piston hammer disposed in said bore for reciprocation under the urging of pressure fluid supplied to first and second opposed chambers formed in said cylinder between said piston hammer and opposed closures for said cylinder, respectively;

an impact blow receiving member supported on said tool and operable to receive impact blows from said piston hammer;

a first valve disposed in said cylinder in one of said chambers and operably connected to said piston hammer for movement therewith in at least one direction of movement of said piston hammer to vent pressure fluid from said one chamber; and a second valve disposed in said cylinder and operably connected to said piston hammer for movement therewith to effect valving pressure fluid to said chambers to effect reciprocation of said piston hammer to deliver repeated impact blows to said impact blow receiving member.

15. The percussion tool set forth in claim 14 wherein:

said piston hammer includes elongated passage means formed therein for conducting pressure fluid to said one chamber by way of said second valve.

16. The percussion tool set forth in claim 15 wherein:

said first valve comprises an elongated tubular sleeve member movable with said piston hammer to uncover an exhaust port in said tool for venting pressure fluid from said one chamber to passage means formed in said impact blow receiving member.

17. The percussion tool set forth in claim 16 wherein:

said piston hammer includes a reduced diameter portion formed thereon and operable to be engaged with said first valve through a lost motion coupling formed between said piston hammer and said first valve.

18. The percussion tool set forth in claim 14 wherein:

said piston hammer includes an elongated reduced diameter portion and means forming a lost motion coupling between said reduced diameter portion and said second valve to permit limited movement of said piston hammer relative to said second valve in at least one direction of movement of said piston hammer to provide for valving pressure fluid to effect movement of said piston hammer to deliver an impact blow to said impact blow receiving member.

19. The percussion tool set forth in claim 18 wherein:

said second valve comprises an elongated, generally cylindrical tubular member disposed for movement on a stem part extending within the other of said chambers and including passage means for conducting pressure fluid therethrough, and said second valve is cooperable with port means formed on said stem part to effect valving pressure fluid to said chambers to effect reciprocation of said piston hammer.

20. The percussion tool set forth in claim 19 wherein:

said second valve is cooperable with port means formed in said cylinder for venting pressure fluid from said other chamber in response to movement of said piston hammer to an impact blow delivering position with respect to said impact blow receiving member.

21. The percussion tool set forth in claim 20 wherein:

said second valve is cooperable with said stem part to uncover a pressure fluid port for conducting pressure fluid through said passage means in said piston hammer to said one chamber to effect movement of said piston hammer away from said impact blow receiving member.

22. A hydraulic reciprocating piston percussion rock drill comprising:

an elongated cylinder member having a cylindrical bore formed therein;

a fronthead member connected to one end of said cylinder member and a backhead member connected to an opposite end of said cylinder member;

an elongated cylindrical reciprocating piston hammer slidably disposed in said bore in said cylinder and supported thereby, said piston hammer having an elongated pressure fluid conducting passage extending therethrough and said piston hammer including opposed reduced diameter portions extending in opposite directions toward said head members, respectively;

an impact blow receiving member supported at one end of said drill and including an impact blow receiving surface operable to be engaged by said piston hammer for delivering impact blows by said drill;

a first elongated tubular sleeve valve supported in said cylinder for movement with said piston hammer and in sleeved relationship over one of said reduced diameter portions of said piston hammer, said first sleeve valve being cooperable with a tubular stem portion of said fronthead for uncovering a pressure fluid exhaust port for venting pressure fluid from a first chamber formed in said cylinder between said piston hammer and said fronthead;

a second elongated tubular sleeve valve disposed in said cylinder between said piston hammer and said backhead and supported for movement on the other of said reduced diameter portions of said piston hammer to effect valving pressure fluid to and from a second chamber formed in said cylinder between said piston hammer and said backhead, said second sleeve valve being cooperable with an elongated stem portion of said backhead and disposed in sleeved relationship over said stem portion of said backhead to effect valving pressure fluid to said second chamber and to said passage in said piston hammer in response to reciprocating movement of said piston hammer; and means for conducting pressure fluid to said backhead for effecting reciprocating movement of said piston hammer to deliver impact blows to said impact blow receiving member and wherein pressure fluid is valved to and from said chambers in said cylinder by said first and second sleeve valves, respectively.

* * * * *